US012290229B2

(12) United States Patent
Saubert et al.

(10) Patent No.: US 12,290,229 B2
(45) Date of Patent: May 6, 2025

(54) AIR AGITATOR NOZZLE SYSTEM

(71) Applicant: TRANSFORM SR BRANDS LLC, Hoffman Estates, IL (US)

(72) Inventors: Michael Saubert, Hoffman Estates, IL (US); Salameh Alsweis, Hoffman Estates, IL (US)

(73) Assignee: TRANSFORM SR BRANDS LLC, Hoffman Estates, IL (US)

( * ) Notice: Subject to any disclaimer, the term of this patent is extended or adjusted under 35 U.S.C. 154(b) by 31 days.

(21) Appl. No.: 17/893,047

(22) Filed: Aug. 22, 2022

(65) Prior Publication Data

US 2022/0408993 A1 Dec. 29, 2022

Related U.S. Application Data

(63) Continuation of application No. 16/209,700, filed on Dec. 4, 2018, now abandoned.

(60) Provisional application No. 62/594,196, filed on Dec. 4, 2017.

(51) Int. Cl.

| | |
|---|---|
| ***A47L 9/08*** | (2006.01) |
| ***A47L 5/14*** | (2006.01) |
| ***A47L 5/36*** | (2006.01) |
| ***A47L 7/04*** | (2006.01) |
| ***A47L 9/04*** | (2006.01) |
| ***A47L 9/12*** | (2006.01) |

(52) U.S. Cl.

CPC ..... *A47L 9/08* (2013.01); *A47L 5/14* (2013.01); *A47L 5/36* (2013.01); *A47L 7/04* (2013.01); *A47L 9/0477* (2013.01); *A47L 9/12* (2013.01)

(58) Field of Classification Search

CPC ..... A47L 5/14; A47L 5/36; A47L 7/04; A47L 9/0477; A47L 9/08; A47L 9/12

See application file for complete search history.

(56) References Cited

U.S. PATENT DOCUMENTS

| | | | | | |
|---|---|---|---|---|---|
| 2,064,344 | A * | 12/1936 | Good | A47L 5/14 | 15/345 |
| 3,268,942 | A * | 8/1966 | Rossnan | A47L 9/08 | 15/346 |
| 4,300,261 | A * | 11/1981 | Woodward | A47L 9/08 | 15/345 |
| 4,333,205 | A * | 6/1982 | Woodward | A47L 5/14 | 15/345 |
| 5,647,092 | A * | 7/1997 | Miwa | A47L 5/14 | 15/397 |
| 6,449,799 | B1 * | 9/2002 | Keller | A47L 11/4088 | 15/345 |
| 6,505,379 | B2 * | 1/2003 | Keller | A47L 11/4088 | 15/345 |
| 6,725,500 | B2 * | 4/2004 | Allen | A47L 9/08 | 15/346 |
| 7,665,181 | B2 * | 2/2010 | Gebhard | A47L 5/14 | 15/320 |

(Continued)

*Primary Examiner* — Marc Carlson

(74) *Attorney, Agent, or Firm* — McAndrews Held & Malloy, Ltd.

(57) ABSTRACT

Systems and methods for providing an air agitator nozzle system are disclosed. In an exemplary embodiment, the system comprises a vacuum and a nozzle. The vacuum is configured to suck particles from a floor surface. The nozzle is configured to spray air at the floor surface to loosen the particles and to push the loosened particles toward the vacuum to be sucked from the floor surface.

14 Claims, 5 Drawing Sheets

(56) References Cited

U.S. PATENT DOCUMENTS

| | | | | |
|---|---|---|---|---|
| 7,788,765 | B2 * | 9/2010 | Allen | A47L 7/0009 15/345 |
| 2012/0260454 | A1 * | 10/2012 | Lester | A47L 5/28 15/345 |
| 2018/0184866 | A1 * | 7/2018 | Gebhard | A47L 5/24 |
| 2019/0167054 | A1 * | 6/2019 | Saubert | A47L 9/08 |

* cited by examiner

AIR AGITATOR NOZZLE SYSTEM

RELATED APPLICATIONS/INCORPORATION BY REFERENCE

The present application is a continuation of U.S. application Ser. No. 16/209,700, filed Dec. 4, 2018, which makes reference to, claims priority to U.S. Application No. 62/594,196, filed Dec. 4, 2017. The aforementioned documents are hereby incorporated herein by reference in their entirety.

FIELD OF THE DISCLOSURE

Certain embodiments of the disclosure relate to systems and methods for providing an air agitator nozzle system.

BACKGROUND OF THE DISCLOSURE

In a conventional vacuum cleaner, the agitator brush is turned off when the vacuum cleaner is used on a hardwood floor, for example. Turning of the agitator brush avoids scratching the wood surface of the hardwood floor. However, this reduces the effectiveness of the vacuum cleaner to clean the hardwood floor since it is only relying on suction power to clean the wood surface of the hardwood floor.

Further limitations and disadvantages of conventional and traditional approaches will become apparent to one of skill in the art, through comparison of such systems with the present disclosure as set forth in the remainder of the present application with reference to the drawings.

BRIEF SUMMARY OF THE DISCLOSURE

Systems, devices, and methods for providing an air agitator nozzle system are provided substantially as illustrated by and/or described in connection with at least one of the figures, as set forth more completely in the claims.

Various advantages, aspects and novel features of the present disclosure, as well as details of an illustrated embodiment thereof, will be more fully understood from the following description and drawings.

DETAILED DESCRIPTION OF THE DISCLOSURE

As utilized herein the terms "circuit" and "circuitry" refer to physical electronic components (i.e., hardware) and any software and/or firmware ("code") which may configure the hardware, be executed by the hardware, and/or otherwise be associated with the hardware. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g." and "for example" set off lists of one or more non-limiting examples, instances, or illustrations.

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated.

Some embodiments of the present disclosure relate to systems, methods, and devices for providing an air agitator nozzle system.

Some embodiments of the present disclosure provide an agitator nozzle system that improves vacuum cleaning by using air nozzles (e.g., jets) to spray air directly onto a surface to be cleaned to loosen dirt and/or dust and push the loosened dirt and/or dust to be sucked into the vacuum via the suction power of the vacuum.

Some embodiments of the present disclosure provide that the source of the sprayed air is an exhaust of the motor of the vacuum cleaner. Thus, in some embodiments, there is no agitator fluid that has to be replaced, for example, after cleaning a room or a part of a room, and/or there is no agitator fluid reservoir that has to be filled and/or refilled and transported with the vacuum cleaner during cleaning. The agitator nozzle system (e.g., an air agitator nozzle system) can provide air (e.g., recycled air) from the exhaust of the motor that is used as an agitator during cleaning. Further, the exhaust of the motor can be used to power the agitator nozzle system including the sprayed air without affecting the power or efficiency of the vacuum cleaner.

Some embodiments of the present disclosure provide a vacuum cleaner that employs suction power, an agitator brush, and an air agitator nozzle to improve cleaning. One or more of the suction power, the agitator brush, and the air agitator nozzle can be employed to enhance surface cleaning of a floor surface whether the floor is carpeted or not (e.g., hardwood floors, tiled floors, etc.).

Figure 1:
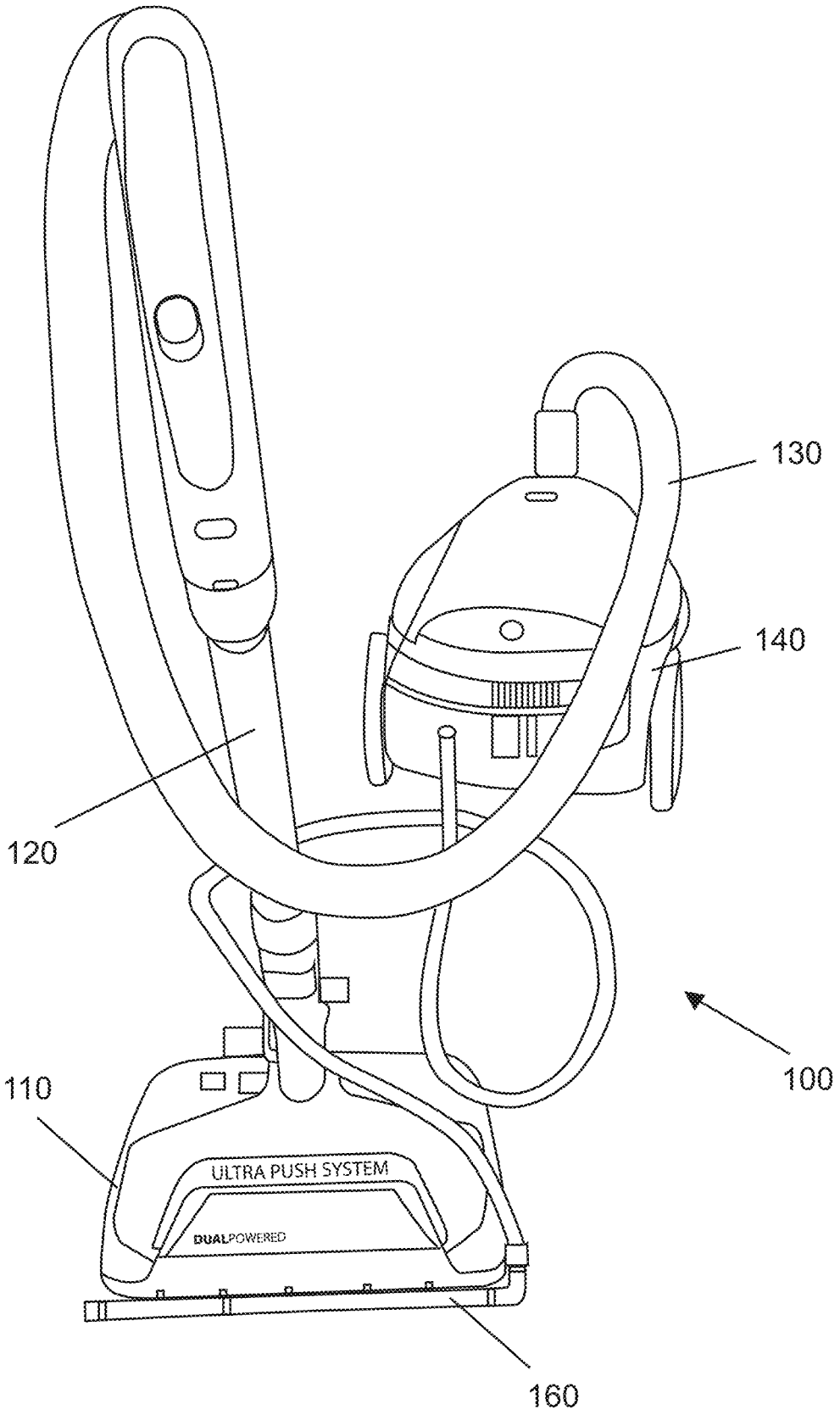
FIG. 1 shows a first view of an embodiment of a vacuum cleaner according to the present disclosure.
Figure 2:
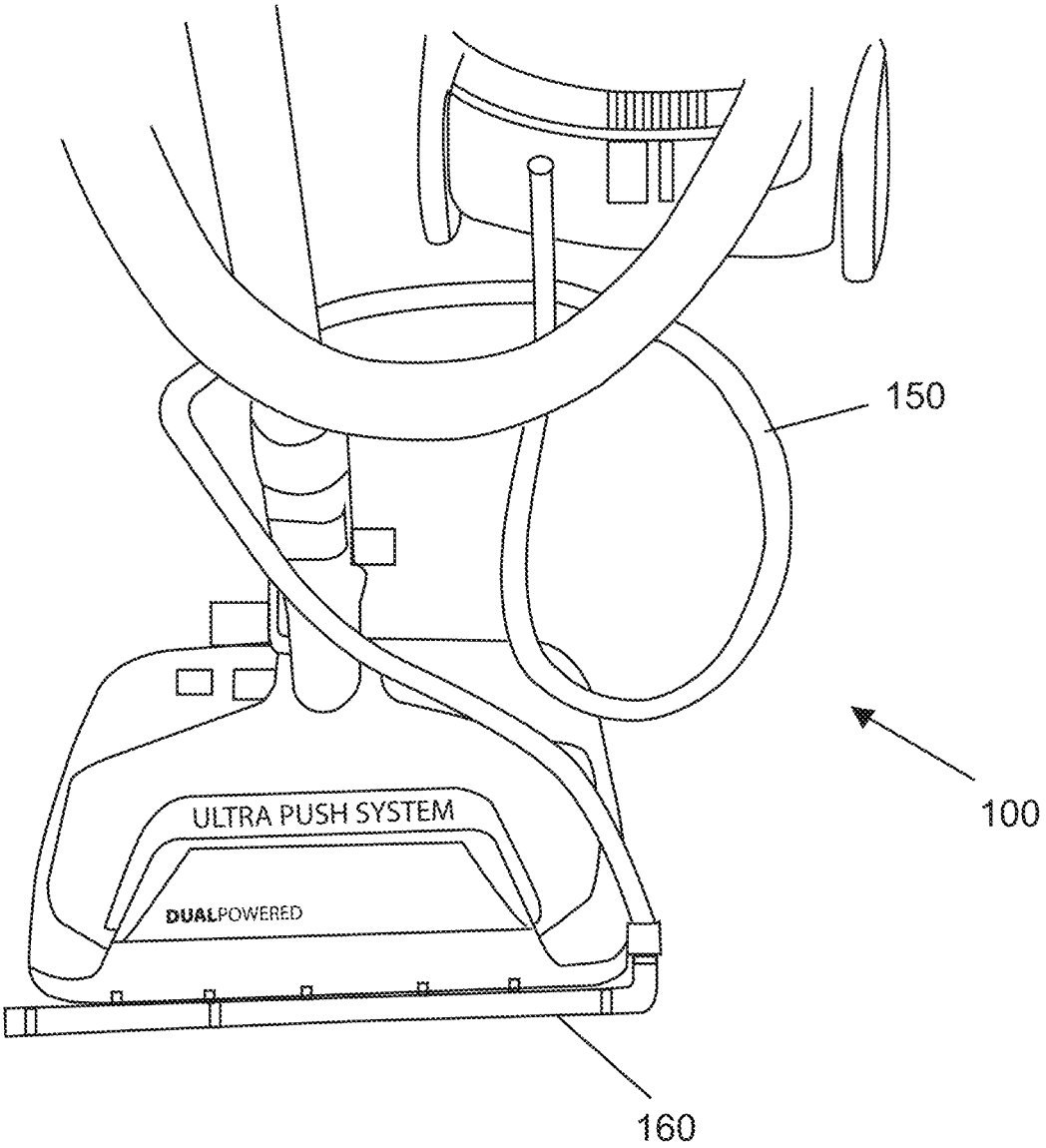
FIG. 2 shows a second view of the embodiment of the vacuum cleaner according to the present disclosure.
Figure 3:
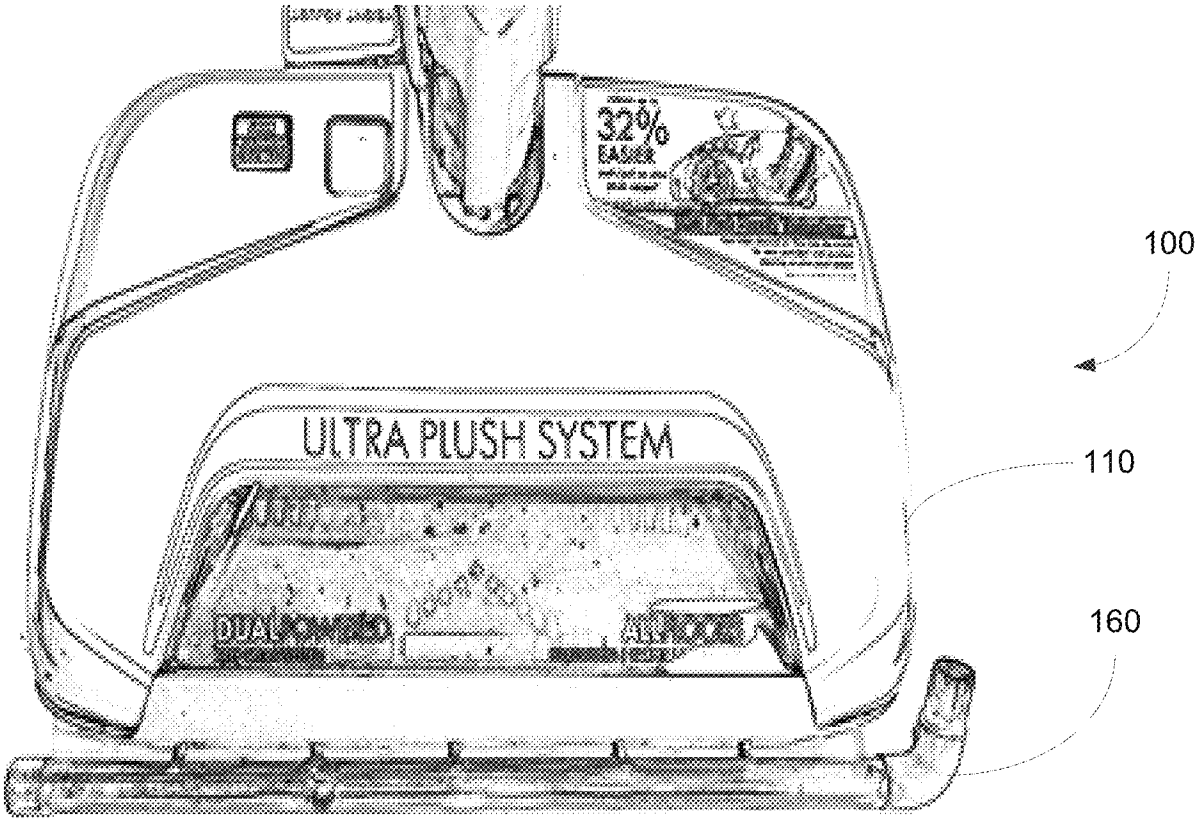
FIG. 3 shows a first view of an embodiment of a vacuum cleaner head according to the present disclosure.
Figure 4:
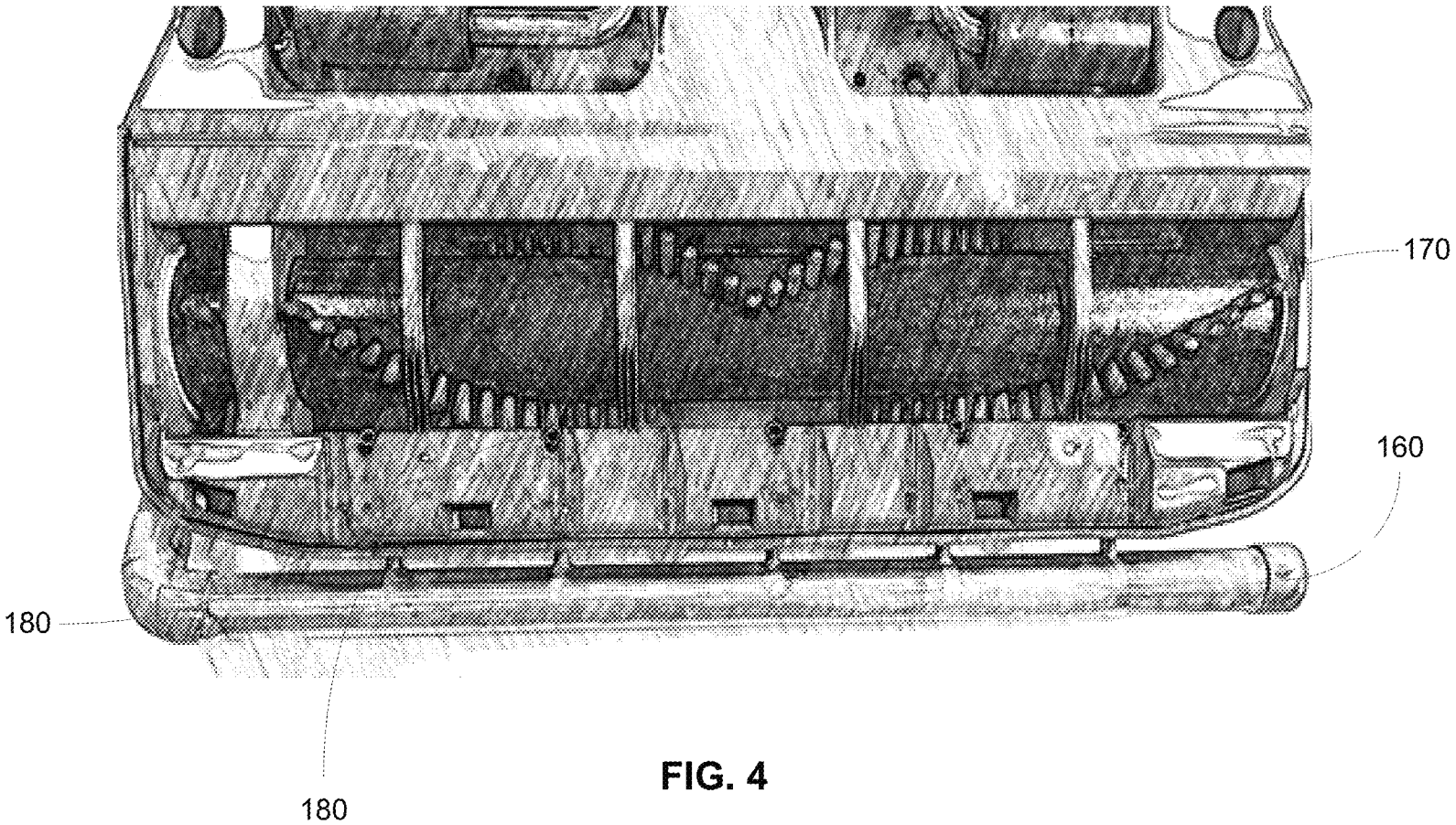
FIG. 4 shows a second view of the embodiment of the vacuum cleaner head according to the present disclosure.
Figure 5:
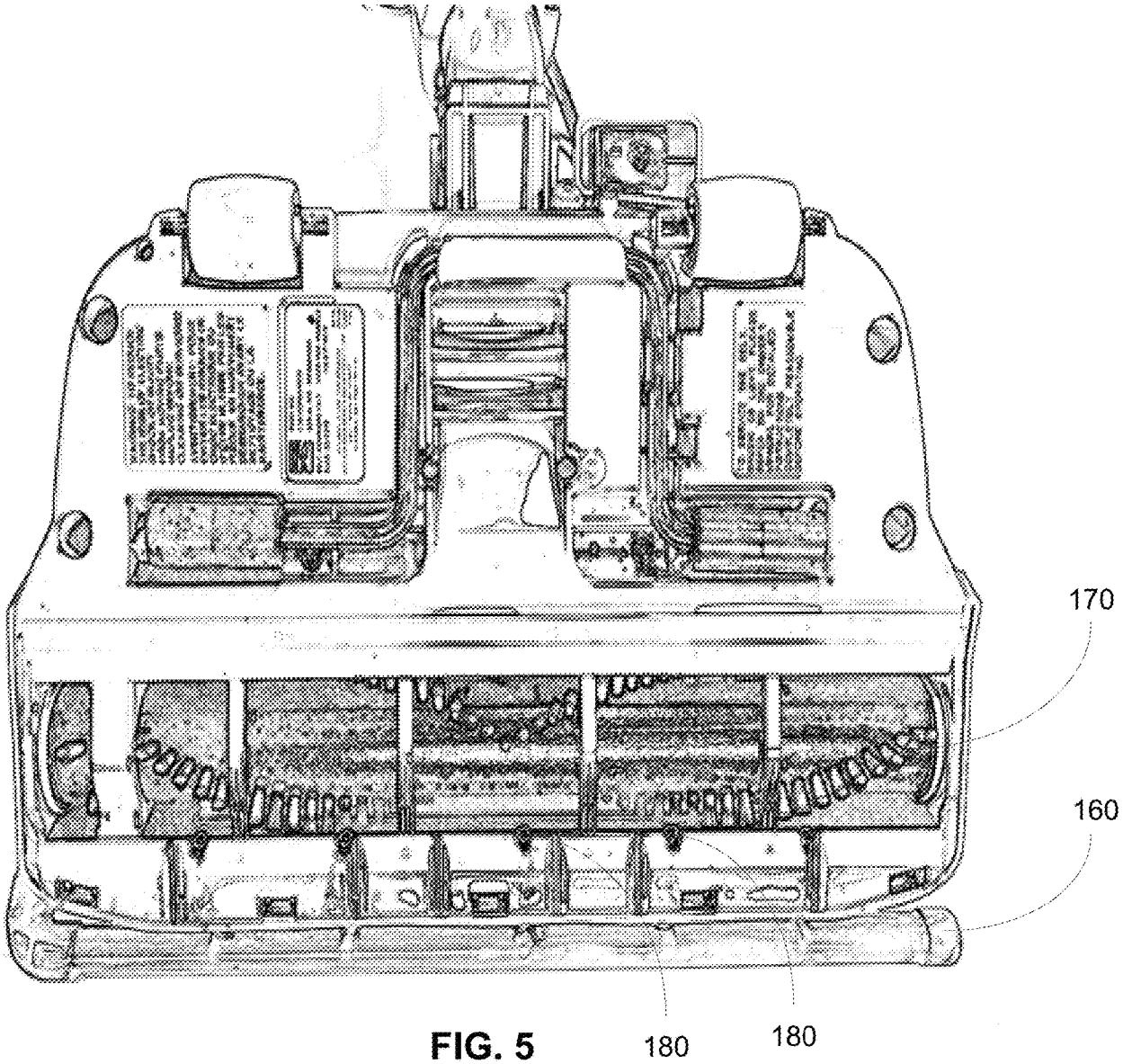
FIG. 5 shows a third view of the embodiment of the vacuum cleaner head according to the present disclosure.

Referring to FIGS. 1-3, an embodiment of a vacuum cleaner is shown according to the present disclosure. The vacuum cleaner 100 can include, for example, a head 110, a wand 120, a hose 130, a housing 140, and an air tube 150. The housing 140 can include, for example, a filter, a dust bag, a vacuum motor, a control system, and a portion of the air agitator nozzle system. Although illustrated as separate from the wand 120, the housing 140 can be integrated with the wand 120 into an upright vacuum cleaner to reduce the length and exposure of the hose 130 and the air tube 150. Referring to FIGS. 4 and 5, a bottom view of a portion of the vacuum cleaner 100 is illustrated. As shown, the head 110 of the vacuum cleaner 100 can include, for example, a manifold 160, an agitator brush 170, and one or more agitator nozzles 180. The manifold 160 can include or be connected to air agitator nozzles 180. Some embodiments provide that the air agitator nozzles 180 are in front of the agitator brush 170 and are pointed in a direction that send air jets toward the surface (e.g., floor surface) that is being cleaned and push the loosened dust and/or dirt particles toward the suction of the vacuum cleaner 100.

Referring to FIGS. 1-5, the head 110 is coupled to the wand 120 which, in turn, is coupled to the hose 130. The hose 130 is coupled to the housing 140. The air tube 150 is coupled to the housing via a portion of the air agitator nozzle system in the housing 140. The air tube 150 is coupled to the manifold 160.

In operation, suction power is turned on when the vacuum is turned on. The agitator brush 170 may be operated or not depending on the settings, controls, and/or surface type that is to be cleaned. Air is sucked via suction power through the head 110, the wand 120, and the hose 130 to the housing 140. The dirt can be filtered by a filter and stored in a bag (e.g., a dust and/or dirt bag or bin) in the housing 140. The air agitator nozzle system in the housing 140 provides air to the air tube 150 which, in turn, provides the air to the manifold 160. The air is expelled through air agitator nozzles 180 that are part of or coupled to the manifold 180 and loosens dirt and/or dust on the surface to be cleaned. Some embodiments provide that the expelled air pushes the loosened dirt and/or dust towards the vacuum head 110 where it is sucked by the suction power of the vacuum cleaner.

Some embodiments contemplate that the air carried by the air tube 150 comes from air exhaust (e.g., air leaving the housing 140 of the vacuum cleaner 100, a vacuum motor exhaust, etc.). Air can be redirected from the air exhaust to the air tube 150 without negatively impacting the performance of the vacuum cleaner 100. Further, by using recycled air from air exhaust (e.g., motor exhaust) as an agitator, there is no need to fill and carry around an agitator fluid reservoir, which can be quite messy and very heavy. In addition, there is no need to periodically replace the dirty fluid in the agitator fluid reservoir.

Some embodiments provide improved cleaning by using air agitator nozzles 180 in combination with the suction power of a vacuum cleaner 100. For example, in some circumstances, it might be advantageous not to use the agitator brush 170. For example, in some instances, the agitator brush 170 might scratch a hardwood floor. By using the suction power in combination with the air agitator nozzles 180, deep-down dirt and/or dust particles in the hard floor or carpet floor are loosened before being sucked by the vacuum cleaner 100.

Some embodiments provide improved cleaning by using air agitator nozzles 180 in combination with the suction power and agitator brush 170 of the vacuum cleaner 100.

Some embodiments provide an air nozzle system that achieves a desired level of deep-cleaning by spraying air before the agitator brush 170 to directly move the dust and/or dirt particles around from hard surfaces or even buried-down dirt to be sucked or, in the case of carpeted floor, further agitated by the agitator brush 170 before being sucked by the vacuum 100.

Some embodiments provide advanced cleaning over conventional cleaning methods by making dust particles easier to remove. For example, air jets 180 before the agitator brush 170 prepare the surface by spraying air onto the surface to loosen the dirt and/or dust. By using recycled air from the motor exhaust of the vacuum cleaner, some embodiments avoid the disadvantages attributable to a fluid agitator reservoir.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A system, comprising:

a vacuum cleaner that is configured to suck particles from a floor surface; and a plurality of nozzles configured to spray air at the floor surface to loosen the particles and to push the loosened particles toward the vacuum cleaner to be sucked from the floor surface, wherein:

the air that is sprayed from the plurality of nozzles comes from an air exhaust of the system, a manifold provides the air from the air exhaust of the system to the plurality of nozzles, and an entirety of the manifold is located in front of the plurality of nozzles while the vacuum cleaner is in use.

2. The system according to claim 1, comprising:

a vacuum motor that generates suction that sucks particles from the floor surface and generates exhaust that is sprayed from the plurality of nozzles to loosen and push the particles.

3. The system according to claim 1, wherein the air exhaust of the system comprises a motor exhaust of the vacuum cleaner.

4. The system according to claim 1, comprising:

an agitator brush disposed behind the manifold, wherein the plurality of nozzles prepares the floor surface for further agitation by the agitator brush.

5. The system according to claim 1, comprising:

a housing that includes a filter to filter out the sucked particles.

6. The system according to claim 5, wherein the vacuum cleaner comprises a head and a first air conduit, wherein the plurality of nozzles is part of the head, wherein the housing is in flow communication with the head via the first air conduit.

7. The system according to claim 6, wherein the head comprises the manifold, wherein the housing is in flow communication with the manifold via a second air conduit.

8. A vacuum cleaner, comprising:

a head that is configured to suck particles from a floor surface; and a plurality of nozzles configured to spray air at the floor surface to loosen the particles and to push the loosened particles toward the head so that the loosened particles are sucked from the floor surface, wherein:

the air that is sprayed from the plurality of nozzles comes from an air exhaust of the system, a manifold provides the air from the air exhaust of the system to the plurality of nozzles, and an entirety of the manifold is located in front of the plurality of nozzles while the vacuum cleaner is in use.

9. The vacuum cleaner according to claim 8, comprising:

an agitator brush disposed in the head, wherein the manifold is disposed in front of the agitator brush so that the plurality of nozzles can prepare the floor surface before the agitator brush agitates the floor surface.

10. The vacuum cleaner according to claim 8, comprising:

a vacuum motor that generates suction that sucks particles from the floor surface and generates exhaust that is sprayed from the plurality of nozzles to loosen and push the particles.

11. The vacuum cleaner according to claim 8, wherein the air exhaust of the system comprises a motor exhaust of the vacuum cleaner.

12. The vacuum cleaner according to claim 8, comprising:

a housing that includes a filter to filter out the sucked particles.

13. The vacuum cleaner according to claim 12, wherein the housing is in flow communication with the head via a first air conduit.

14. The vacuum cleaner according to claim 13, wherein the head comprises the manifold, wherein the housing is in flow communication with the manifold via a second air conduit.

* * * * *